US011874085B2

(12) United States Patent
Barnett

(10) Patent No.: US 11,874,085 B2
(45) Date of Patent: Jan. 16, 2024

(54) TRIGGER-TRAVERSE CROSSBOW

(71) Applicant: Barnett Outdoors, LLC, Tarpon Springs, FL (US)

(72) Inventor: David A. Barnett, Tampa, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 17/827,370

(22) Filed: May 27, 2022

(65) Prior Publication Data

US 2022/0381532 A1 Dec. 1, 2022

Related U.S. Application Data

(60) Provisional application No. 63/194,557, filed on May 28, 2021.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12
See application file for complete search history.

(56) References Cited

U.S. PATENT DOCUMENTS 6,895,950 B2 5/2005 Gillet et al.
8,136,514 B2 5/2012 Howard et al.
9,354,015 B2 5/2016 Yehle
9,494,379 B2 11/2016 Yehle
9,494,380 B1 11/2016 Yehle
9,528,792 B1 12/2016 Chang
9,568,269 B1 2/2017 Chang
9,958,232 B1 5/2018 Egerdee et al.
10,077,965 B2 9/2018 Yehle
10,082,359 B2 9/2018 Yehle
10,126,088 B2 11/2018 Yehle
10,175,023 B2 1/2019 Yehle
10,254,073 B2 4/2019 Yehle
10,295,295 B2 5/2019 Shaffer et al.
10,378,853 B1 8/2019 Liu
10,495,403 B1 12/2019 Liu
(Continued)

OTHER PUBLICATIONS

Co-pending U.S. Appl. No. 17/738,811, filed May 6, 2022, titled "Multi-Stroke Lever Action Crossbow."
(Continued)

*Primary Examiner* — John A Ricci
(74) *Attorney, Agent, or Firm* — Jones Walker LLP

(57) ABSTRACT

A trigger-traverse crossbow. The crossbow has a trigger latch block slidingly connected to the flight track. The trigger latch block is configured to engage and retain the bowstring. A cocking mechanism is configured to draw the trigger latch block with the bowstring from an initial position near a forward end of the flight track to a cocked position. A one-way retention mechanism is configured to immobilize the trigger latch block against linear movement in a forward direction along the flight track. A trigger-traverse mechanism is configured to slide the trigger latch block in a forward direction to its initial position after the bowstring is released. In one embodiment, the cocking mechanism includes a cocking lever pivotally connected to the crossbow body along with one pair or two pairs of cocking hooks that move in response to the rotation of the cocking lever.

28 Claims, 13 Drawing Sheets

(56) References Cited

U.S. PATENT DOCUMENTS

| | | | |
|---|---|---|---|
| 10,670,368 | B1 | 6/2020 | Liu |
| 10,690,436 | B1 | 6/2020 | Kempf et al. |
| 10,900,737 | B1 | 1/2021 | Hensel et al. |
| 11,085,728 | B2 | 8/2021 | Yehle |
| 11,221,191 | B2 | 1/2022 | Bednar et al. |
| 11,236,963 | B2 | 2/2022 | Bednar et al. |
| 11,236,964 | B2 | 2/2022 | Bednar et al. |
| 2018/0321011 | A1 | 11/2018 | Yehle |

OTHER PUBLICATIONS

PCT International Searching Authority/US, International Search Report and Written Opinion, dated Sep. 2, 2022, for Applicant's counterpart application No. PCT/US2022/031413.

TRIGGER-TRAVERSE CROSSBOW

CROSS-REFERENCE TO RELATED APPLICATION

This application claims the benefit of, and priority to, U.S. Provisional Patent Application No. 63/194,557, filed on May 28, 2021, which is incorporated herein by reference in its entirety.

FIELD OF THE INVENTION

This invention relates to weapons. More specifically, it relates to a trigger-traverse crossbow.

BACKGROUND

Current marketplace has several models of pistol crossbows that shoot short arrows, commonly referred to as "bolts." One type of a pistol crossbow is known as a break-action crossbow, originally designed by the company named BARNETT and sold under the COMMANDO trademark. A break-action crossbow generally functions in the following manner: a cocking mechanism draws a bowstring from its rest position to its fully drawn position in one continuous stroke. The cocking mechanism involves at least one longitudinal arm terminating in a hook, wherein the arm is pivotally attached to the rear stock portion of the crossbow. To cock the crossbow, a user rotates the rear stock in a downward direction relative to the body of the crossbow. This breaking motion causes the cocking arm to longitudinally translate along the body of the crossbow. As the cocking arm moves back relative to the crossbow body, the hook draws the bowstring toward its cocked position.

Currently known break-action crossbow cocking mechanisms draw the bowstring from its rest position to its fully drawn position in one continuous stroke. A major flaw of such single-stroke cocking mechanism is that it requires a high degree of strength from the user. To reduce the amount of force needed to cock such crossbow, many manufacturers limit the amount of bowstring draw weight, which, in turn, limits the range and accuracy of the crossbow. Furthermore, the cocking arms are generally positioned outside of the crossbow track, and, therefore, may present a safety concern and be prone to damage.

Another problem associated with currently known crossbows pertains to crossbows utilizing movable trigger latch mechanisms. This mechanism generally involves a movable trigger latch block. The trigger latch block is configured to engage the bowstring, draw the bowstring back into its fully cocked position, and, after the shot, the user must bring the trigger latch block into its initial position, at the front of the flight track. Typical trigger-traverse crossbows require that, after the shot, the user must release the trigger latch block and then, manually push the trigger latch block forward along the flight track until it captures the bowstring. This manual step of returning the trigger latch block to its initial position slows down the rate at which the crossbow can be reloaded. Furthermore, because the user must have physical access to the trigger latch to move it along the flight track, the flight track cannot be obstructed by a scope, a bridge, or another structural component of the crossbow. Therefore, the traditional movable trigger latch mechanism limits the design options for the crossbow.

There are some models of movable trigger latch crossbows that use a winding mechanism to move the trigger latch block along the flight track. Most of these models rely on belts and cables to move the trigger latch block along the flight rack. Although not prevalent in the art, some models of crossbows have cocking mechanisms that use a lead screw to move the trigger latch block along the flight track. The lead screw is screw-threadedly connected to the trigger latch block, wherein rotation of the lead screw about the center axis causes the trigger latch block to move linearly along the flight track of the crossbow. In these models, the user must spin the lead screw to linearly translate the latch block. To reduce the amount of force needed to cock the crossbow, the lead screw will typically have a shallow, low-helix thread pitch (less than 10 mm). The shallow pitch reduces the amount of strength needed to spin the lead screw to translate the load bearing trigger latch block toward the fully drawn position.

However, these types of winding mechanisms have several major flaws. Although the shallow pitch of the lead screw reduces the amount of force needed to cock the crossbow, it also limits any form of manual linear override. Thus, the only way to move the trigger latch block either forward or backward along the flight track of the crossbow is by spinning the lead screw. This can be accomplished via a manual winding mechanism or a battery-powered motor—both of which have serious disadvantages. With respect to the electrical motor solution, if the battery is depleted, the crossbow cannot be operated until the battery is replaced. With respect to manual winding mechanisms, this option can be very tedious and time-consuming for the user. For example, manual winding mechanisms typically require a significant number of revolutions via a crank handle—for example, between ten and thirty revolutions to fully cock the crossbow. Then, after the shot, the user must repeat the same high number of revolutions in the opposite direction to bring the trigger latch block back to its initial position at the front of the crossbow to reengage the bowstring. After reengaging the bowstring, the user must again repeatedly rotate the crank handle to re-cock the bowstring. This winding and unwinding process is time-consuming and creates a major inconvenience for faster paced activities, such as target shooting and sight-in adjustment.

Accordingly, what is needed is a break-action crossbow having an improved cocking mechanism that alleviates the amount of effort a user must exert to cock the crossbow, while enabling the user to quickly cock the crossbow and then quickly return the trigger latch block to its initial position, without requiring the user to wind and unwind the cocking mechanism.

BRIEF DESCRIPTION OF THE DRAWING VIEWS

DETAILED DESCRIPTION OF SELECTED EMBODIMENTS

Figure 1:
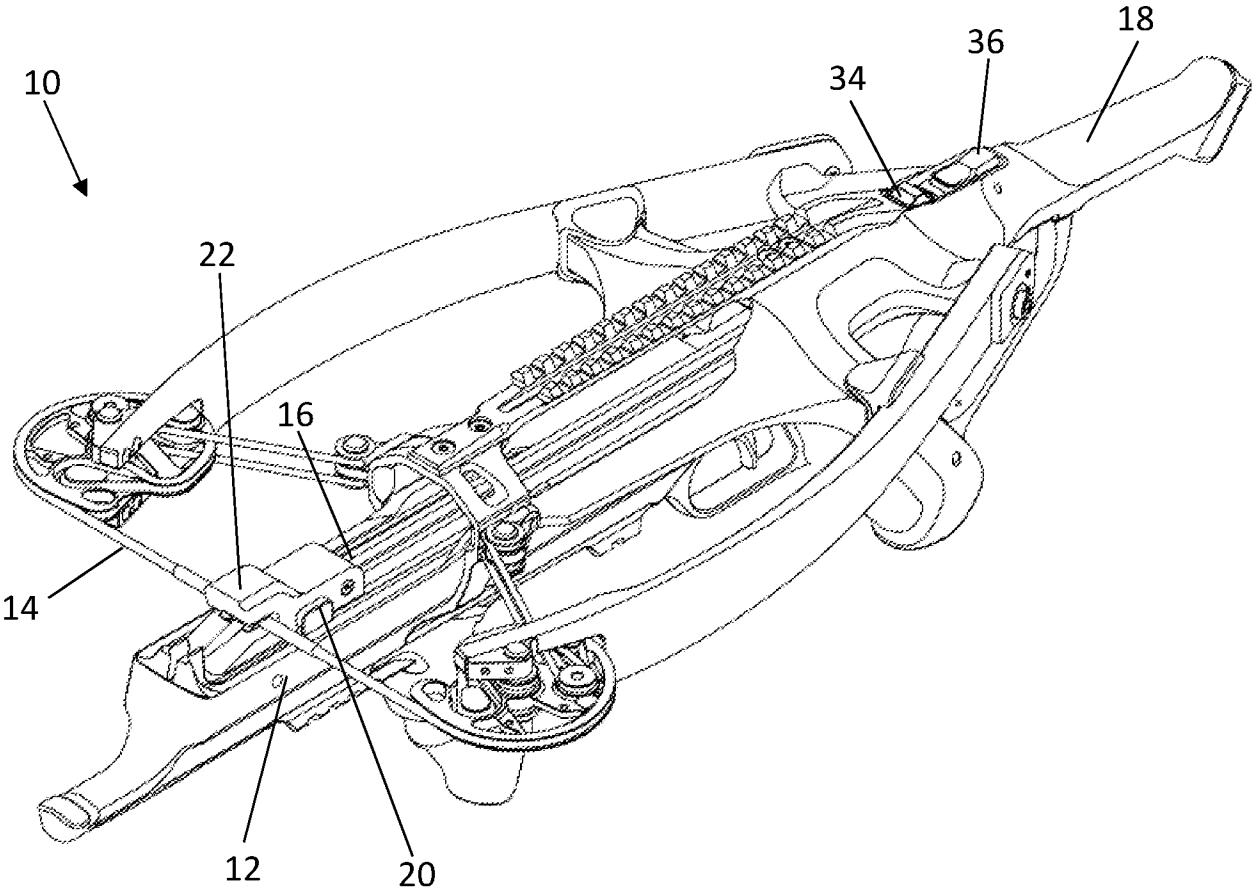
FIG. 1 depicts a perspective view of a traverse-trigger lever action crossbow in a default configuration, with the cocking lever in a fully closed position and the trigger latch block in an initial position at the front of the flight track.

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

FIGS. 1-12 depict an embodiment of a trigger-traverse lever action crossbow having a two-stroke cocking mechanism. This two-stroke cocking mechanism provides a significant mechanical advantage over a single-stroke mechanism. Unlike single-stroke cocking mechanisms that require the user to full draw the bowstring with a single rotation of the cocking lever, the novel and nonobvious two-stroke cocking mechanism enables the user to accomplish this task via twice the rotational input from the cocking lever.

The two-stroke cocking mechanism significantly ameliorates the task of cocking the crossbow by reducing the effort load and strength required. The reduction in the amount of required user strength needed to cock the crossbow affords an opportunity for increased crossbow draw weight, increased crossbow draw length, and/or decreased cocking lever size and/or angle of rotation.

In an embodiment, the trigger-traverse crossbow comprises a trigger latch block, a high helix-lead screw, a spring motor, a one-way clutch, cocking hooks, a cocking lever, and a bowstring. The high-helix lead screw is rotationally coupled to the trigger latch block via a thread profile. The spring motor is pre-wound and coupled to one end of the lead screw, and the one-way clutch is coupled to the other end thereof.

In an embodiment, the trigger-traverse mechanism functions in the following manner. Disengaging the one-way clutch releases the high-helix lead screw. The pre-wound/charged spring motor rotates the lead screw driving the trigger latch block forwards towards the bowstring. The trigger latch block is driven forward towards the resting bowstring, until the bowstring is captured by a latch mechanism of the trigger latch block.

The cocking lever is coupled to the cocking hooks running on both sides of the trigger latch block. Rotating the cocking lever draws the cocking hooks back. This, in turn, draws back the bowstring via the trigger latch block.

As the trigger latch block is pulled back, the high-helix lead screw rotates, winding and charging the spring motor. The one-way clutch prevents the high-helix lead screw from winding back and, therefore, retains the trigger latch block and bowstring in their partially drawn position when the cocking lever is returned for handover.

Once the cocking lever is fully rotated, the bowstring can be held at the halfway point for handover via the trigger latch block, high-helix lead screw, and one-way clutch. Returning the cocking lever to its closed position moves the cocking hooks forward, allowing the second pair of the cocking hooks to re-couple with the trigger latch block in the halfway position.

Rotating the cocking lever a second time repeats the process of drawing the trigger latch block back until the bowstring reaches its fully drawn position. Upon release, the linear travel of the trigger latch block is held for a second time via the lead screw and one-way clutch. The cocking lever is returned to its closed position, moving the cocking hooks forward. The bowstring can then be released from the trigger latch block via a trigger pull. The bowstring returns to its initial resting position, propelling an arrow positioned on the flight track. The user then disengages the one-way clutch from the lead screw, which causes the wound spring motor to rotate the lead screw, thereby bringing the trigger latch block to its initial position at the front of the crossbow.

With reference to FIG. 1, dual-stroke trigger-traverse lever action crossbow 10 includes a body 12 and a bowstring 14 connected thereto. The crossbow body 12 has a top surface 16 (i.e., flight track 16) along which bowstring 14 travels when the crossbow 10 is being cocked and shot.

Figure 2:
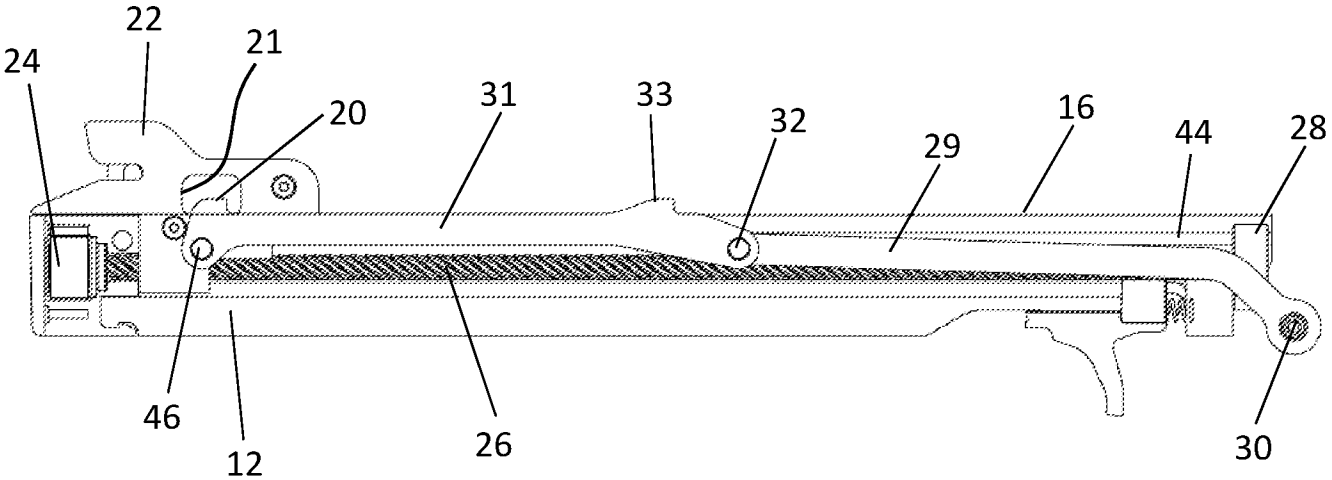
FIG. 2 depicts a side view of the cocking and trigger release mechanisms in a default configuration, with the cocking lever in a fully closed position.

FIG. 1 shows an initial, un-cocked position of the trigger-traverse crossbow 10. In this initial position, the cocking lever 18 (rear stock) is in its closed position. A first pair of cocking hooks 20 protrude above flight track 16 of the crossbow body 12. The cocking hooks 20 are configured to engage receptacles 21 of the trigger latch block 22, as depicted in FIG. 2. The cocking hooks 20 are configured to move in a rearward direction along flight track 16 when cocking lever 18 is rotated from its closed position. Trigger latch block 22 is configured to engage bowstring 14 and draw the bowstring 14 in the rearward direction with movement of trigger latch block 22.

Figure 3:
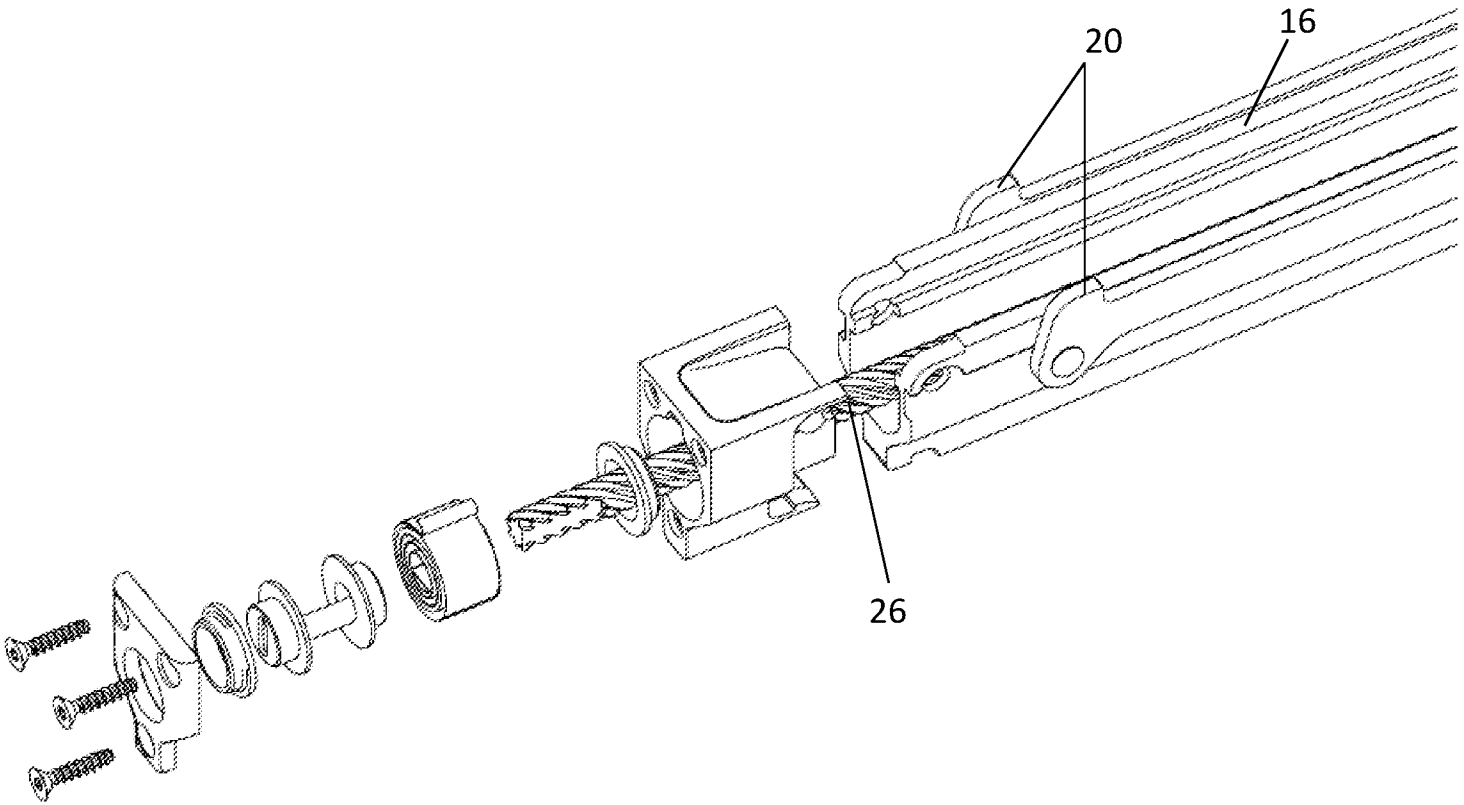
FIG. 3 is an exploded perspective view of the trigger release mechanism.

With reference to FIG. 2, a spring motor 24 is positioned at the front of the crossbow 10. As shown in FIGS. 2 and 3, the spring motor 24 is connected to one end of a helix lead screw 26. A one-way clutch 28 engages the second end of the lead screw 26. When engaged, the one-way clutch 28 enables the lead screw 26 to rotate only in one direction and immobilizes the lead screw 26 against rotation in the opposite direction. In this way, the lead screw 26 and the one-way clutch 28 provide a one-way retention mechanism configured to immobilize the trigger latch block 22 against linear movement in a forward direction along the flight track 16. When the crossbow 10 is being cocked, the trigger latch block 22 travels back along the flight track 16 of the crossbow body 12. As the trigger latch block 22 moves back, it rotates the lead screw 26 about its center axis. This rotation winds and charges the spring motor 24. After the crossbow 10 is fired, the user may press the trigger release button 34 (shown in FIG. 1), which disengages the one-way clutch 28. When the one-way clutch 28 is disengaged, the spring motor 24 unwinds, rotating the lead screw 26, which causes the trigger latch block 22 to move toward its initial position at the front of the crossbow (shown in FIGS. 1 and 2). In this way, the spring motor 24 provides a trigger-traverse mechanism configured to return trigger latch block 22 to its initial position after the bowstring is released.

Referring still to FIG. 2, a rearward end of cocking arm 29 may be pivotally secured to cocking lever 18 via pivot point connection 30, while a forward end of cocking arm 29 may be pivotally secured to cocking link 31 via pivot point connection 32. In certain embodiments, the first cocking hooks 20 are formed at a forward end of cocking link 31 and second cocking hooks 33 are formed near a rearward end of cocking link 31. Crossbow 10 may include a pair of cocking arms 29 and a pair of pivotally connected cocking links 31, with lead screw disposed between the pairs.

With reference again to FIG. 1, a lever-release actuator 36 retains the cocking lever 18 in its closed position. To cock the crossbow 10, the user disengages the lever-release actuator 36, which enables the user to rotate the cocking lever 18.

Figure 4:
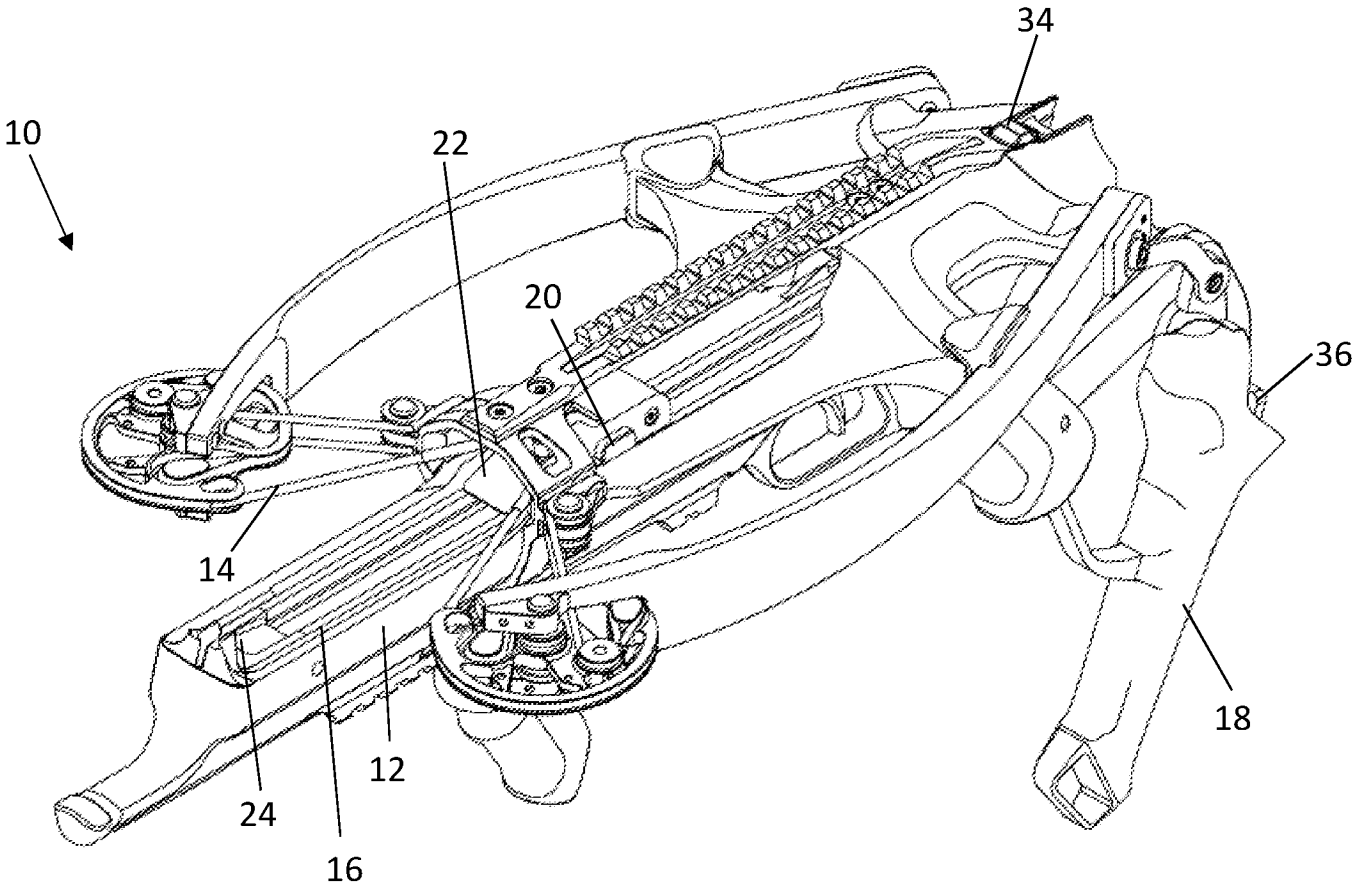
FIG. 4 depicts a perspective view of the traverse-trigger lever action crossbow, with the cocking lever in its fully rotated position. The first pair of the cocking hooks draws the trigger latch block toward its intermediate position along the flight track.

As shown in FIG. 4, the cocking lever 18 may be rotated in a downward direction relative to the body 12 of the crossbow 10. When the cocking lever 18 is rotated away from its closed position, the first cocking hooks 20 travel in a rearward direction along the crossbow body 12, thereby translating the trigger latch block 22 in the rearward direction along the flight track 16 and drawing the bowstring 14 in the rearward direction.

Figure 5:
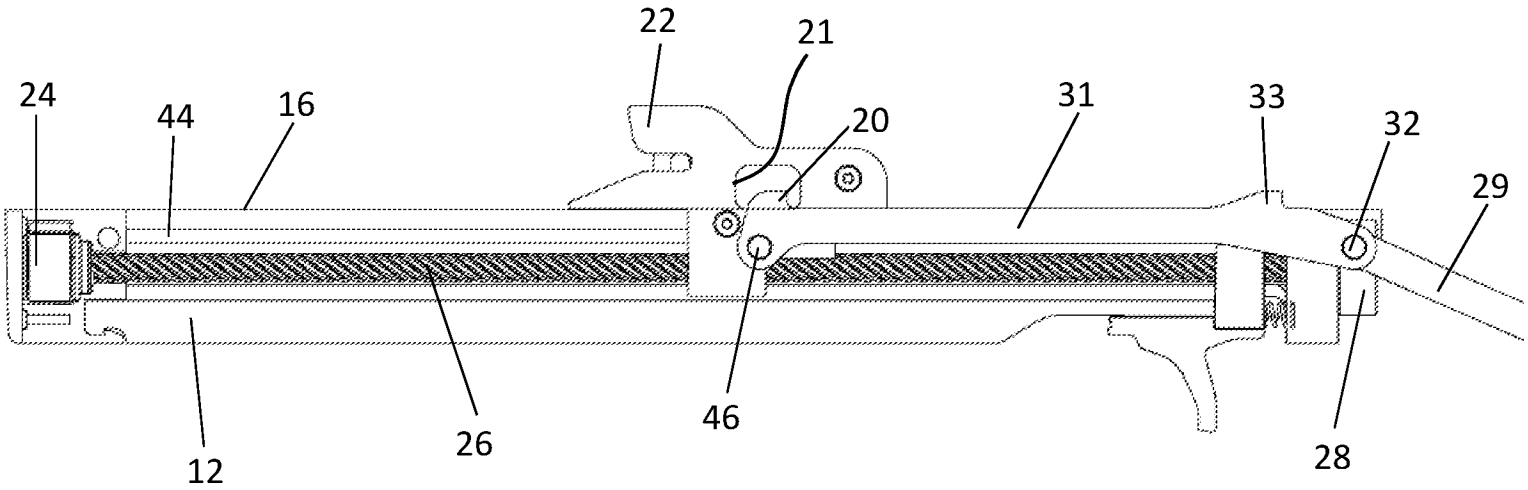
FIG. 5 depicts a side view of the cocking and trigger release mechanisms, with the cocking lever in its fully rotated position. The first pair of the cocking hooks draws the trigger latch block toward its intermediate position along the flight track.

Referring to FIG. 5, as the cocking lever 18 rotates downward, it pulls the cocking arm 29 and the cocking link 31 in the rearward direction relative to the crossbow body 12. As the cocking link 31 moves in the rearward direction, the pair of first cocking hooks 20 engages the trigger latch block 22 and pulls the trigger latch block 22 in the rearward direction, which rotates the helix lead screw 26 in a clockwise direction about a central axis of lead screw 26.

Figure 6:
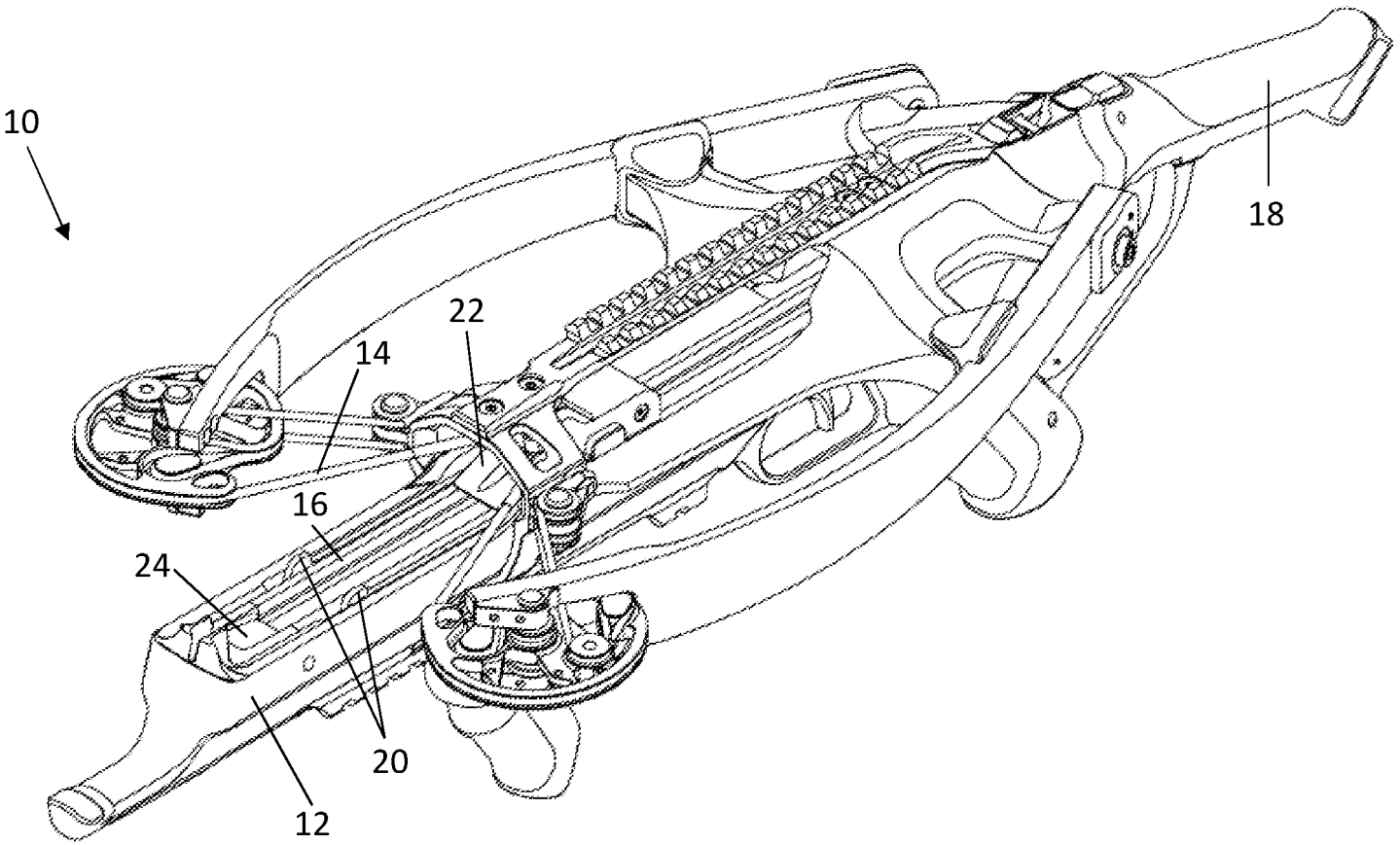
FIG. 6 depicts a perspective view of the traverse-trigger lever action crossbow, with the cocking lever returned to its closed position, and the trigger latch block remaining in its intermediate position.
Figure 7:
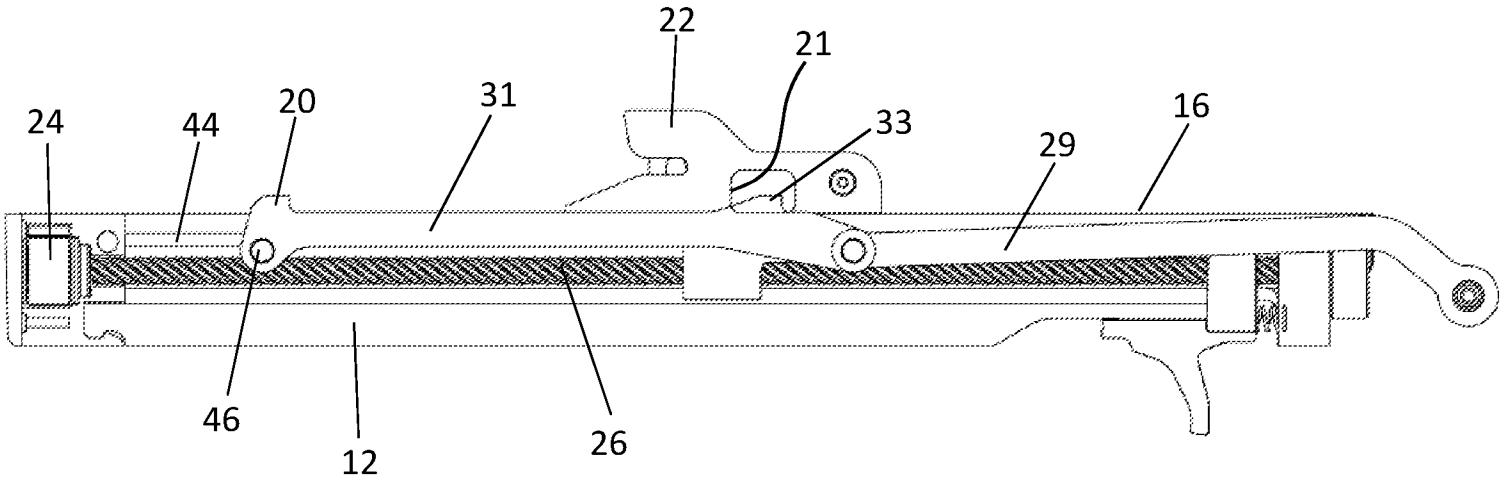
FIG. 7 depicts a side view of the cocking and trigger release mechanisms, with the cocking lever returned to its closed position and the trigger latch block remaining in its intermediate position.

With reference to FIGS. 6 and 7, returning the cocking lever 18 to its initial closed position completes a first cocking stroke. As the cocking lever 18 is returned to its closed position, the cocking arm 29 and the cocking link 31 move in a forward direction to return to their initial positions. After the first cocking stroke, the trigger latch block 22 is positioned in a midsection of the crossbow body 12. Because the one-way clutch 28 immobilizes the lead screw 26 against counterclockwise rotation, the trigger latch block 22 remains stationary at the midsection of the crossbow body 12. When the cocking arm 29 and the cocking link 31 return to their initial positions, the pair of second cocking hooks 33 engages the receptacles 21 of trigger latch block 22. At this point, the crossbow 10 is ready for the second cocking stroke.

Figure 8:
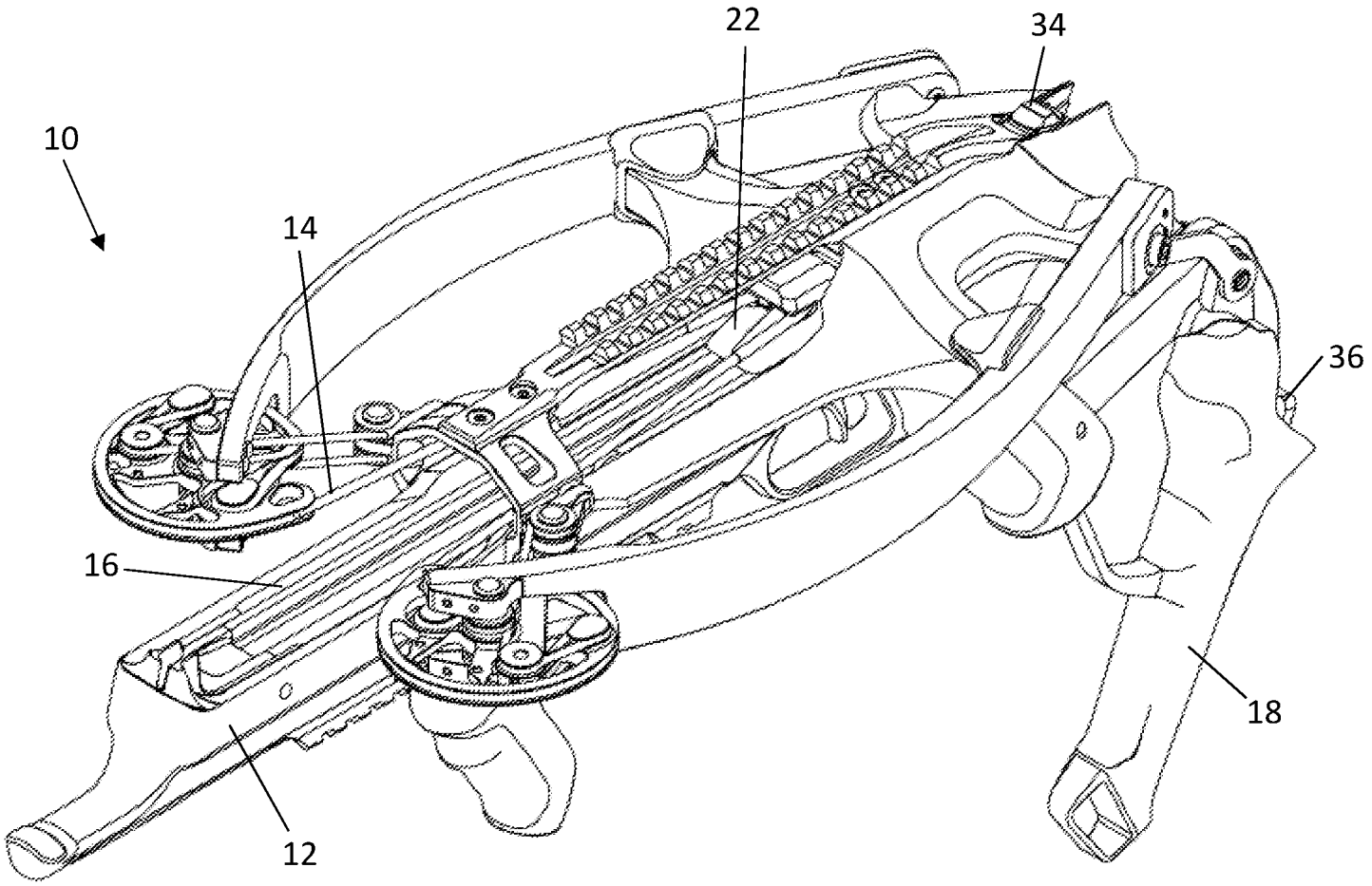
FIG. 8 depicts a perspective view of the traverse-trigger lever action crossbow, with the cocking lever in its fully rotated position, and the trigger latch block being drawn toward its cocked position by the second pair of the cocking hooks.
Figure 9:
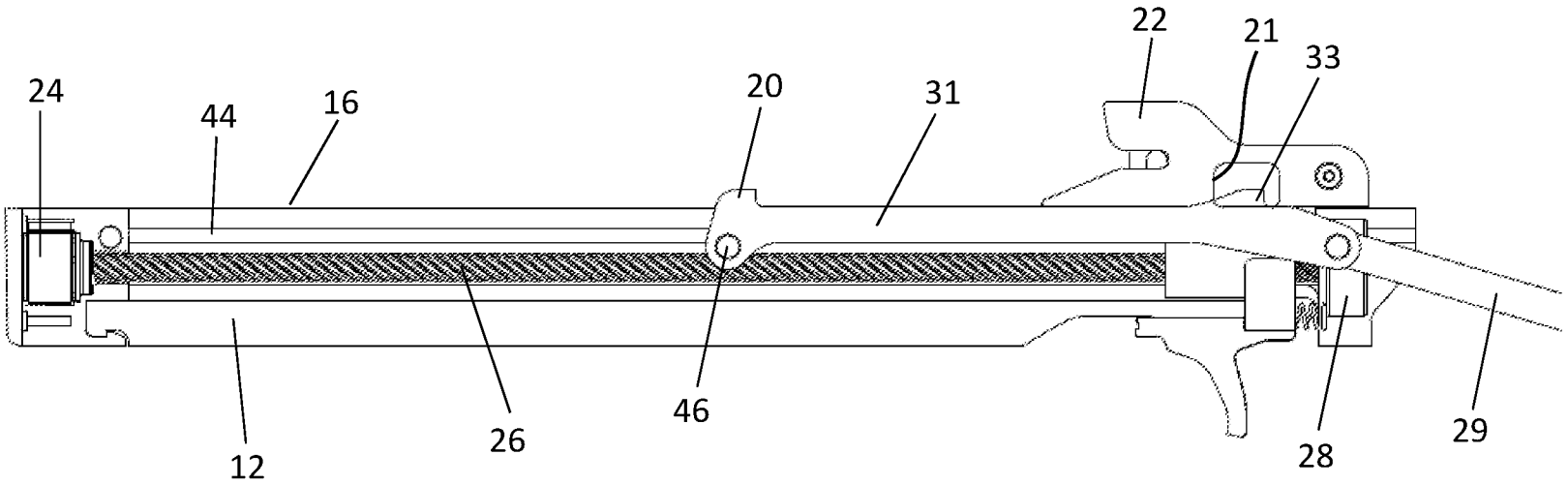
FIG. 9 depicts a side view of the cocking and trigger release mechanisms, with the cocking lever in its fully rotated position, and the trigger latch block being drawn toward its cocked position by the second pair of the cocking hooks.

FIGS. 8-11 depict the second stroke of the cocking lever. FIGS. 8 and 9 show that as the cocking lever 18 rotates downward relative the crossbow body 12, the pair of second cocking hooks 33 engages the receptacle 21 of trigger latch block 22 and draws the trigger latch block 22 rearward toward the trigger assembly of the crossbow 10. As the trigger latch block 22 moves rearward relative to the flight track 16, the trigger latch block 22 rotates the helix lead screw 26 in a clockwise direction, further winding and charging the spring motor 24. FIGS. 8 and 9 show the trigger latch block 22 and bowstring 14 in the fully cocked position.

Figure 10:
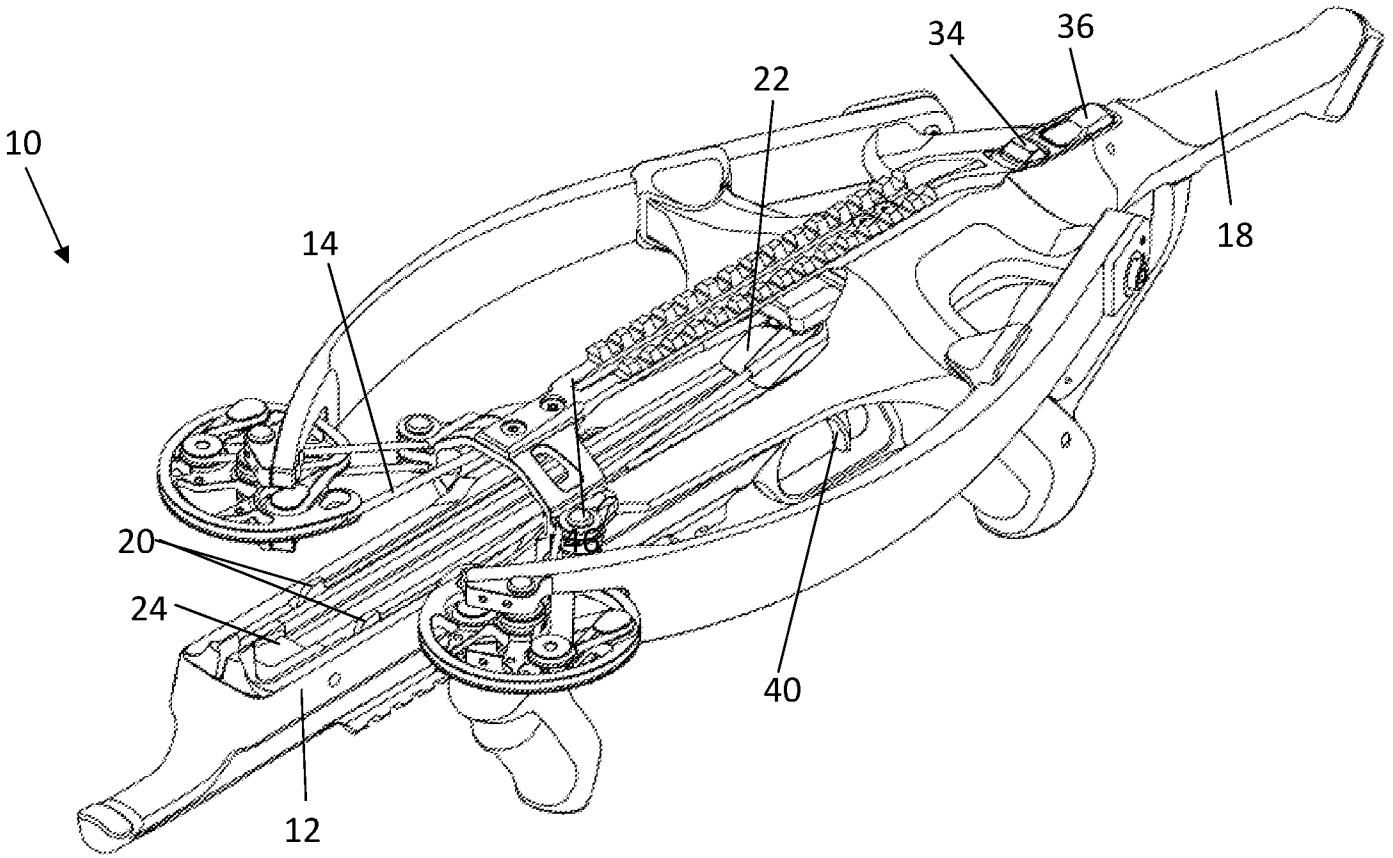
FIG. 10 depicts a perspective view of the traverse-trigger lever action crossbow, with the cocking lever returned to its closed position, and the trigger latch block remaining in its cocked position.
Figure 11:
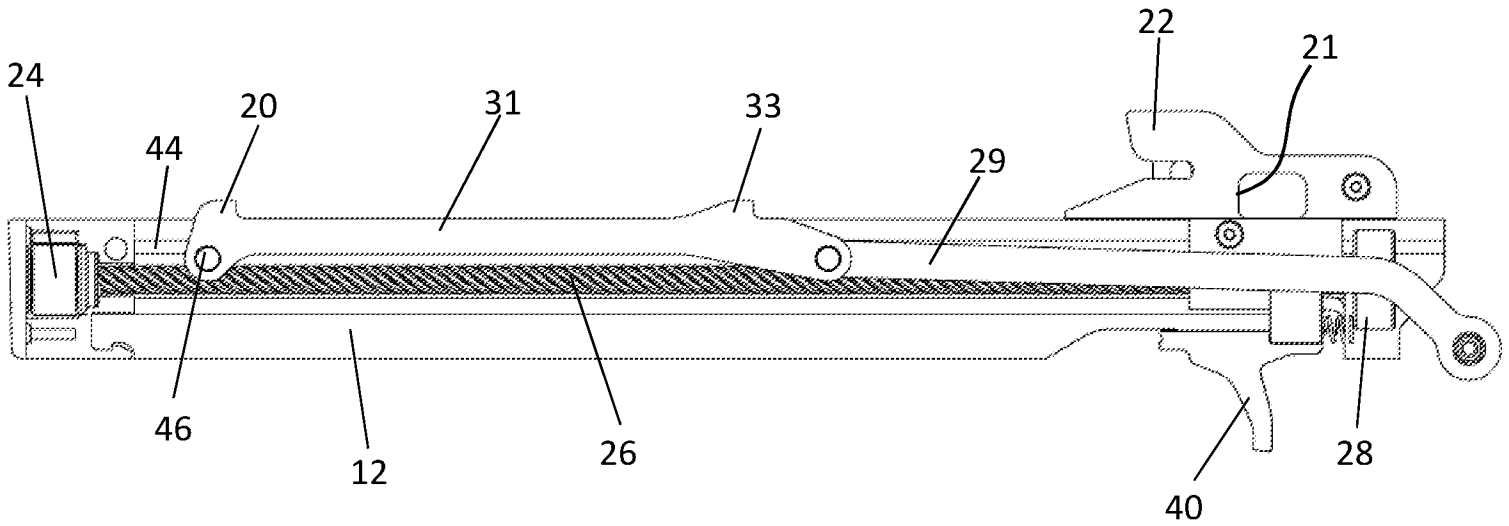
FIG. 11 depicts a side view of the cocking and trigger release mechanisms, with the cocking lever returned to its closed position, and the trigger latch block remining in its cocked position.
Figure 12:
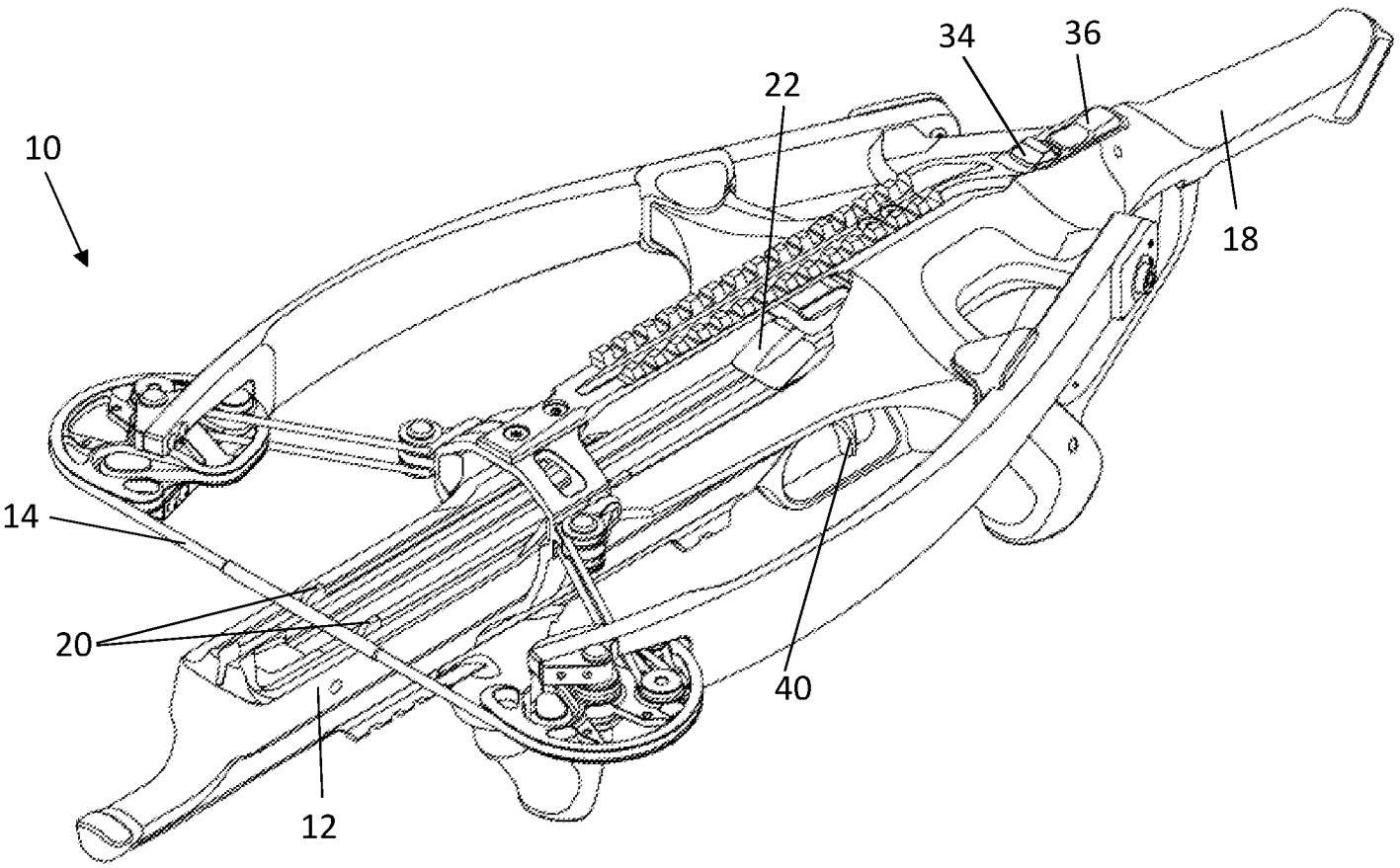
FIG. 12 depicts a perspective view of the traverse-trigger lever action crossbow, after the trigger pull releases the bowstring from the trigger latch block, and the trigger latch block remains in its fully drawn position.

FIGS. 10 and 11 show the cocking lever 18 returned to its closed position and the cocking hooks 20 and 33 returned to their initial default positions. At this point, the crossbow 10 is ready to be fired. The user may load an arrow onto the flight track 16 and pull the trigger 40. FIG. 12 illustrates the configuration of crossbow 10 after the bowstring 14 is released from the trigger assembly. In this configuration, the bowstring 14 returns to its initial resting position, while the trigger latch block 22 remains in the rearward position along the flight track 16.

To return the trigger latch block 22 to its default position at the front end of the crossbow 10, the user may press the trigger release button 34. The trigger release button 34 disengages the one-way clutch 28 from the helix lead screw 26, enabling the lead screw 26 to rotate in a counterclockwise direction about the central axis of the lead screw 26 in response to the spring tension of the spring motor 24. The counterclockwise rotation of the lead screw 26 brings the trigger latch block 22 to the front of the crossbow 10, into the position shown in FIGS. 1 and 2. At this point, the crossbow 10 is ready for the next two-stroke cocking cycle.

With reference to FIGS. 2, 5, 7, 9, and 11, one embodiment of the crossbow body 12 includes a longitudinal groove 44 in the lateral side of the body 12. The cocking link 31 has a set of pins 46 residing within the longitudinal groove 44, enabling the cocking link 31—and, therefore, the pairs of first and second cocking hooks 20 and 33—to slide along the body 12 of the crossbow 10. The cocking link 31 is pivotally connected to the cocking arm 29, which, in turn, is pivotally connected to the cocking lever 18. In this manner, downward rotation of the cocking lever 18 causes the cocking link 31 to slide in the rearward direction relative to the crossbow body 12, and the upward rotation of the cocking lever 18 causes the cocking link 31 to slide in a forward direction relative to the crossbow body 12.

FIG. 3 shows an exploded view of the spring motor 24 and the helix lead screw 26. The lead screw 26 has a steep, high-helix thread pitch in the range of 10 to 25 mm, or greater. The steep, high-helix thread pitch enables the trigger latch block 22 to rotate the lead screw 26 when the trigger latch block 22 is pulled in the rearward direction by the cocking hooks 20 and 33. The linear travel of the trigger latch block 22 winds the lead screw 26 for the purpose of charging a spring and/or elastic motor. Once the crossbow 10 is cocked, the loaded bowstring 14 is released, and the one-way clutch 28 is disengaged, the charged spring motor 24 rotates the lead screw 26, which swiftly drives the trigger latch block 22 back to its initial position, in one singular motion. This trigger latch block 22 return mechanism requires little to no effort by the operator. As explained above, the charging of the spring motor 24 is achieved automatically when the trigger latch block 22 is drawn in the rearward direction relative to the crossbow body 12, due to the lever action cocking with cocking lever 18. In this way, the trigger latch block mechanism further reduces the operator's time and effort spent on the crossbow cocking process and process of returning the trigger latch block 22 to its initial position, thus providing greater convenience to the operator during use.

As explained above, some prior art movable trigger latch crossbows have a cocking mechanism that requires the user to repeatedly rotate a crank handle to linearly translate the trigger latch block along the crossbow body. Unlike the present invention, these types of movable trigger latch mechanisms use a low thread pitch lead screw—i.e., less than 10 mm. A key differentiating factor between low and high helix thread pitch lead screws is that a low helix thread can drive high loads via rotational input but cannot be linearly overridden due to the shallow pitch. Thus, when a low pitch helix lead screw is employed, the trigger block latch cannot slide relative to the crossbow body in response to a linear directional force. In sharp contrast, a high-pitch helix thread lead screw used in the present invention can be overridden via a linear force—i.e., moving a lead screw nut (integrated into the trigger latch block 22) along the thread of the lead screw 26 causes the lead screw 26 to rotate. In other words, prior art movable trigger latch mechanisms require that the user rotate the lead screw to linearly translate the trigger latch block. By contrast, in the present invention, the cocking hooks apply a linear force to move the trigger latch block toward the cocked position, and then, the spring motor rotates the high-pitch lead screw to bring the trigger latch block to its initial position at the front of the flight track.

The trigger traverse mechanism disclosed herein utilizes a power spring and high helix lead screw to drive the trigger latch block towards the bowstring upon actuation of a release switch. This drastically reduces the operator's effort and reduces human error. Furthermore, because the user does not need to have physical access to the trigger latch block as it travels along the flight track, this structural configuration affords an opportunity for alternative designs of the crossbow, including introduction of "bridges" that cross over the flight track for an alternate cam design, as well as various cable and scope rail configurations.

In the embodiment described above, the crossbow has a two-stroke design, which draws the trigger latch block back to the fully drawn position in two full cocking lever rotations. In an alternate embodiment, the crossbow can be configured to use more than two strokes to cock the crossbow—for example, 3, 4, or up to 10 cocking stages/strokes to provide greater mechanical advantage for the operator. In other alternate embodiments, the crossbow can be configured to one stroke to cock the crossbow with only a single pair of cocking hooks. In still other alternate embodiments, the crossbow can use other cocking mechanisms besides a cocking lever and cocking hooks.

In the embodiment shown in FIGS. 1-12, the multi-stage cocking mechanism and the trigger traverse mechanism are integrated into a pistol format crossbow. However, in another embodiment, these mechanisms can be integrated into larger full-size crossbows of varied styles and specifications.

In the embodiment shown in FIGS. 1-12, the cocking lever is in the form of a break action lever at the rear of the stock. However, in alternate embodiments, the cocking lever can be located in a different position relative to the crossbow body—for example, an under lever or a side lever may be used to cock the crossbow in a similar manner.

In the embodiment depicted in FIGS. 1-12, the handover position for the trigger latch block 22 is at the halfway point along the flight track 16. However, in alternate embodiments, the handover point could be located in any position along the draw stroke length of the track.

In the embodiment shown in FIGS. 1-12, the trigger traverse mechanism is driven by a power spring. However, in alternate embodiments, the mechanism could be driven by a constant force spring, torsion spring, tension spring, compression spring, elasticated bungee, elasticated tape, or battery powered DC motor to achieve the same result of driving the trigger latch block.

In the embodiment shown in FIGS. 1-12, the linear travel of the trigger latch block 22 charges the drive mechanism via a high-helix lead screw 26. In an alternate embodiment, the drive mechanism could be charged via a toothed belt loop and gear, toothed rack and gear, flat belt and spool, or corded line and spool to achieve the same result of charging the drive mechanism.

In the embodiment shown in FIGS. 1-12, the linear travel of the trigger latch block 22 is held and prevented from reversing via a one-way spring-loaded clutch 28. In an alternative embodiment, this function can be achieved via a one-way dog clutch, one-way friction clutch, ratchet and pawl, one, two or more spring-loaded plungers and catches, or one, two or more spring-loaded latch hooks and catches.

In the embodiment shown in FIGS. 1-12, the cocking mechanism of crossbow 10 includes a cocking lever, a pair of first cocking hooks, and a pair of second cocking hooks. In alternate embodiments, the trigger traverse mechanism disclosed herein may be included in crossbows having other cocking mechanisms. For example, the trigger traverse crossbow may use a crank cocking device, a rope cocking device, or any other cocking device.

Figure 13:
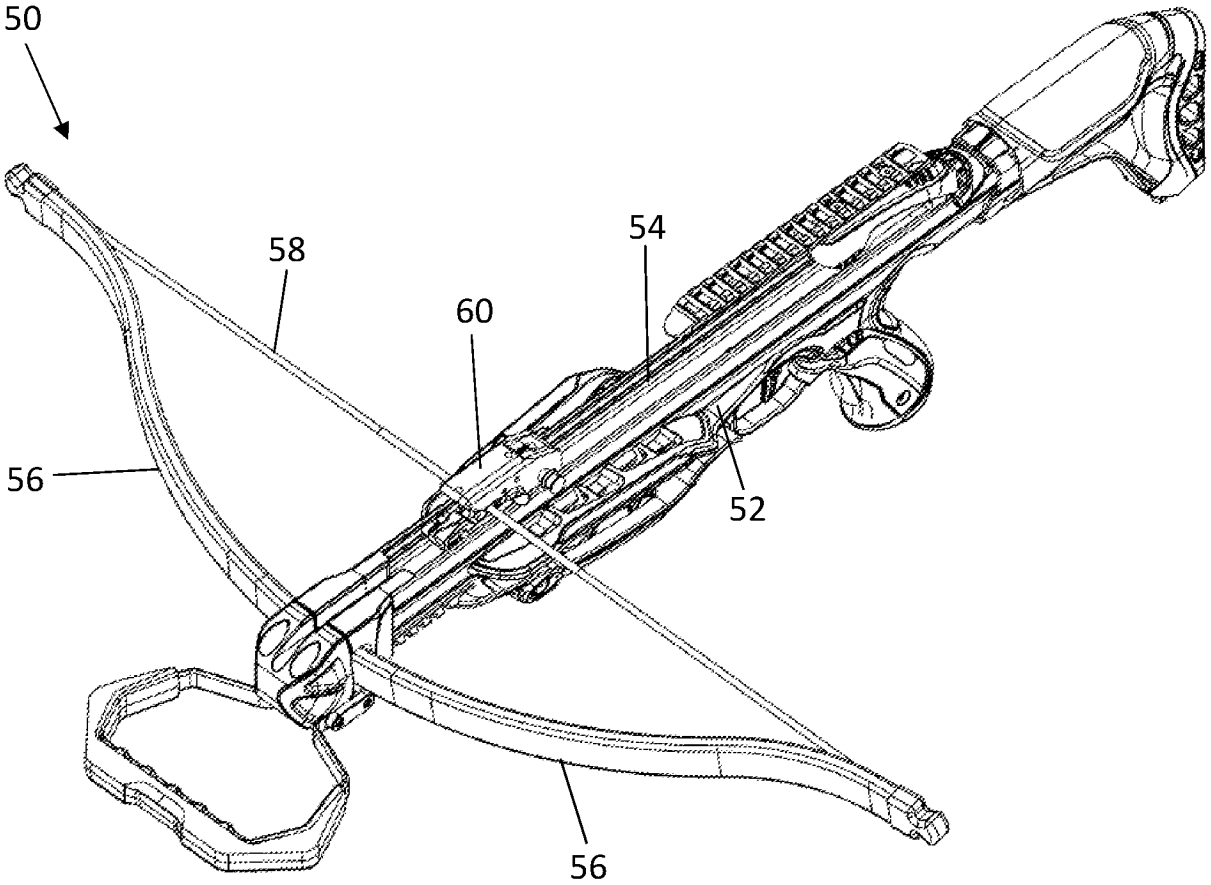
FIG. 13 is a perspective view of an alternate trigger-traverse crossbow.

FIG. 13 illustrates an alternate embodiment of the trigger-traverse crossbow including the trigger traverse mechanism disclosed herein. Trigger-traverse crossbow 50 includes body 52 with flight rail 54. Limbs 56 extend outward from a forward end of body 52 with bowstring 58 extending between the outer portions of limbs 56. Crossbow 58 also includes trigger latch block 60 slidingly connected to body 52, a one-way retention mechanism configured to prevent forward movement of trigger latch block 60 along flight rail 54 until a trigger release is activated, and a trigger traverse mechanism. The trigger latch block 60 may engage the bowstring 58 at the forward end of the crossbow. The trigger latch block 60 may be drawn in a rearward direction along flight rail 54 using any cocking mechanism. As trigger latch block 60 moves in the rearward direction, it draws bowstring 58 in the rearward direction from the initial position shown in FIG. 13 into a cocked position. After the bowstring 58 is released with activation of the trigger, the user may activate the trigger release to disengage the one-way retention mechanism, thereby allowing the trigger traverse mechanism to draw trigger latch block 60 in the forward direction toward the forward end of the crossbow 50. In one embodiment, the one-way retention mechanism of crossbow 50 includes a helix lead screw threadedly engaging the trigger latch block, with the helix lead screw engaging a spring motor on one end and engaging a one-way clutch on the second end.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A crossbow comprising:

a crossbow body having a flight track;

a bowstring extending across the crossbow body;

a trigger latch block slidingly connected to the crossbow body, wherein the trigger latch block is configured to draw the bowstring in a rearward direction along the flight track;

a first cocking hook and a second cocking hook each slidingly connected to the crossbow body and each configured to draw the trigger latch block in the rearward direction along the flight track, wherein the second cocking hook is disposed rearward of the first cocking hook;

a cocking lever pivotally connected to the crossbow body, wherein the cocking lever is configured to draw the trigger latch block in a rearward direction from an initial position to an intermediate position along the crossbow body with the first cocking hook upon a first rotation of the cocking lever, and wherein the cocking lever is configured to draw the trigger latch block in the rearward direction from the intermediate position to a cocked position along the crossbow body with the second cocking hook upon a second rotation of the cocking lever;

a one-way retention mechanism configured to immobilize the trigger latch block against linear movement in a forward direction along the flight track; and a trigger configured to engage the trigger latch block in the cocked position, wherein the trigger is configured to selectively cause the trigger latch block to release the bowstring.

2. The crossbow of claim 1, wherein the one-way retention mechanism includes a helix lead screw and a one-way clutch, wherein the helix lead screw threadedly engages the trigger latch block.

3. The crossbow of claim 2, wherein the helix lead screw has a steep, high helix thread pitch.

4. The crossbow of claim 3, wherein the thread pitch of the helix lead screw is at least 10 mm.

5. The crossbow of claim 3, wherein the thread pitch of the helix lead screw is in the range of 10 mm and 25 mm.

6. The crossbow of claim 2, further comprising a trigger-traverse mechanism configured to slide the trigger latch block along the crossbow body to the initial position after the bowstring is released.

7. The crossbow of claim 6, wherein the trigger-traverse mechanism is configured to return the trigger latch block to the initial position in response to activation of a button or switch.

8. The crossbow of claim 7, wherein the activation of the button or switch disengages the one-way clutch.

9. The crossbow of claim 6, wherein the trigger-traverse mechanism includes a spring motor charged by a rotation of the helix lead screw in response to rearward movement of the trigger latch block along the flight track, wherein the spring motor is configured to rotate the helix lead screw in order to move the trigger latch block to the initial position.

10. The crossbow of claim 6, wherein the trigger- traverse mechanism includes a mechanical or electrical component configured to rotate the helix lead screw in order to move the trigger latch block to the initial position.

11. The crossbow of claim 1, wherein the trigger latch block includes a receptacle configured to receive and engage the first cocking hook and the second cocking hook.

12. The crossbow of claim 1, further comprising:

a cocking arm pivotally connected to the cocking lever; and a cocking link pivotally connected to the cocking arm, wherein the cocking link is slidingly connected to the crossbow body.

13. The crossbow of claim 12, wherein the first cocking hook and the second cocking hook are integrally formed with the cocking link.

14. The crossbow of claim 12, wherein the crossbow body further includes a longitudinal groove configured to receive a pin engaging the cocking link, wherein the pin slides within the longitudinal groove to guide the sliding of the cocking link along the crossbow body.

15. A crossbow comprising:

a crossbow body having a flight track;

a bowstring extending across the crossbow body;

a trigger latch block slidingly connected to the crossbow body, wherein the trigger latch block is configured to draw the bowstring in a rearward direction along the flight track;

a pair of first cocking hooks and a pair of second cocking hooks each slidingly connected to the crossbow body and each configured to draw the trigger latch block in the rearward direction along the flight track, wherein the pair of second cocking hooks is disposed rearward of the pair of first cocking hooks;

a cocking lever pivotally connected to the crossbow body, wherein the cocking lever is configured to draw the trigger latch block in a rearward direction from an initial position to an intermediate position along the crossbow body with the pair of first cocking hooks upon a first rotation of the cocking lever, and wherein the cocking lever is configured to draw the trigger latch block in the rearward direction from the intermediate position to a cocked position along the crossbow body with the pair of second cocking hooks upon a second rotation of the cocking lever;

a one-way retention mechanism configured to immobilize the trigger latch block against linear movement in a forward direction along the flight track; and a trigger configured to engage the trigger latch block in the cocked position, wherein the trigger is configured to selectively cause the trigger latch block to release the bowstring.

16. The crossbow of claim 15, further comprising:

a helix lead screw threadedly engaging the trigger latch block;

a trigger-traverse mechanism configured to slide the trigger latch block to the initial position after the bowstring is released.

17. The crossbow of claim 16, wherein the trigger-traverse mechanism includes a spring motor charged by a rotation of the helix lead screw in response to rearward movement of the trigger latch block along the flight track, wherein the spring motor is configured to rotate the helix lead screw in order to move the trigger latch block to the initial position.

18. The crossbow of claim 16, wherein the trigger traverse mechanism includes a mechanical or electrical component configured to rotate the helix lead screw in order to move the trigger latch block to the initial position.

19. The crossbow of claim 15, wherein the trigger latch block includes one or more receptacles configured to receive and engage the pair of first cocking hooks and the pair of second cocking hooks.

20. The crossbow of claim 15, further comprising:

a pair of cocking arms pivotally connected to the cocking lever; and a pair of cocking links pivotally connected to the pair of cocking arms, wherein the cocking links are slidingly connected to the crossbow body.

21. The crossbow of claim 20, wherein the pair of first cocking hooks and the pair of second cocking hooks are integrally formed with the pair of cocking links.

22. A crossbow comprising:

a crossbow body having a flight track;

a bowstring extending across the crossbow body;

a trigger latch block slidingly connected to the crossbow body, wherein the trigger latch block is configured to draw the bowstring in a rearward direction along the flight track;

a first cocking member and a second cocking member each operatively associated with the crossbow body and each configured to draw the trigger latch block in the rearward direction along the flight track, wherein the second cocking member is disposed rearward of the first cocking member;

a cocking mechanism configured to draw the trigger latch block in the rearward direction along the flight track from an initial position to a cocked position;

a one-way retention mechanism configured to immobilize the trigger latch block against linear movement in a forward direction along the flight track;

a trigger configured to engage the trigger latch block in the cocked position, wherein the trigger is configured to selectively cause the trigger latch block to release the bowstring; and a trigger-traverse mechanism configured to slide the trigger latch block along the crossbow body to the initial position after the bowstring is released.

23. The crossbow of claim 22, wherein the one-way retention mechanism includes a helix lead screw and a one-way clutch, wherein the helix lead screw threadedly engages the trigger latch block.

24. The crossbow of claim 23, wherein the helix lead screw has a steep, high helix thread pitch.

25. The crossbow of claim 23, wherein the trigger-traverse mechanism is configured to return the trigger latch block to the initial position in response to activation of a button or switch.

26. The crossbow of claim 23, wherein the trigger-traverse mechanism includes a spring motor charged by a rotation of the helix lead screw in response to rearward movement of the trigger latch block along the flight track, wherein the spring motor is configured to rotate the helix lead screw in order to move the trigger latch block to the initial position.

27. The crossbow of claim 23, wherein the trigger-traverse mechanism includes a mechanical or electrical component configured to rotate the helix lead screw in order to move the trigger latch block to the initial position.

28. The crossbow of claim 22, wherein the cocking mechanism includes a cocking lever pivotally connected to the crossbow body and a first cocking hook slidingly connected to the crossbow body, wherein the first cocking member is a first cocking hook and the second cocking member is a second cocking hook, and wherein the first and second cocking hooks are each slidingly connected to the crossbow body.

* * * * *